US009613504B2

(12) United States Patent
Wargon

(10) Patent No.: US 9,613,504 B2
(45) Date of Patent: Apr. 4, 2017

(54) HAND CARRIED ALERTING SOUND GENERATOR DEVICE

(71) Applicant: Kenneth Wargon, Issaquah, WA (US)

(72) Inventor: Kenneth Wargon, Issaquah, WA (US)

( * ) Notice: Subject to any disclaimer, the term of this patent is extended or adjusted under 35 U.S.C. 154(b) by 0 days.

(21) Appl. No.: 15/050,874

(22) Filed: Feb. 23, 2016

(65) Prior Publication Data

US 2016/0247365 A1 Aug. 25, 2016

Related U.S. Application Data

(60) Provisional application No. 62/119,372, filed on Feb. 23, 2015, provisional application No. 62/143,272, filed on Apr. 6, 2015, provisional application No. 62/198,202, filed on Jul. 29, 2015.

(51) Int. Cl.
*G08B 3/10* (2006.01)
*G08B 25/12* (2006.01)

(52) U.S. Cl.
CPC ..... *G08B 3/10* (2013.01); *G08B 25/12* (2013.01)

(58) Field of Classification Search
CPC ..... G08B 25/016; G08B 5/36; G08B 7/06; G08B 15/004; G08B 25/08; G08B 25/10; G08B 3/10; G08B 5/22; G08B 7/066
USPC ..... 340/6.1
See application file for complete search history.

(56) References Cited

U.S. PATENT DOCUMENTS 4,100,581 A 7/1978 Slack et al.
4,236,147 A 11/1980 Calvin
5,475,368 A 12/1995 Collins
5,774,039 A 6/1998 Housley
5,900,802 A 5/1999 Segan
6,285,294 B1 9/2001 Avinger
6,721,408 B1 4/2004 Bain et al.
(Continued)

OTHER PUBLICATIONS

Parts Express: http://www.parts-express.com/dayton-audio-bct-2-bone-conducting-transducer-exciter-45mm-dia-x-25mm-h-240-612.

(Continued)

*Primary Examiner* — Mark Blouin
(74) *Attorney, Agent, or Firm* — John R. Benefiel

(57) ABSTRACT

A method and device for generating alerting sounds and broadcasting the same into the interior of a building so that an occupant can be made aware of the presence of a visitor at a door to the building. The sounds are generated by an exciter feature of a transducer held in a case, able to be gripped in one hand of a user, the exciter feature being able to be pressed against an exterior surface of the door by the user moving the case to a position adjacent to the door. The transducer vibrates its exciter feature in correspondence with audio signals transmitted to the transducer to broadcast corresponding sounds into the interior of the building by resonance induced in the door by the vibrating exciter feature. The sounds can resemble conventional alerting sounds such as a knocking or ringing sounds, and/or can be a spoken message either prerecorded in an audio source or created contemporaneously by being spoken by the user into a microphone. The device may be hand carried door to door as by delivery personnel and emergency workers and used to effectively alert occupants and eliminate the need for hand knocking or yelling a message through the door.

19 Claims, 5 Drawing Sheets

(56) References Cited

U.S. PATENT DOCUMENTS

| | | | | |
|---|---|---|---|---|
| 6,759,955 | B2 | 7/2004 | Koneff et al. | |
| 7,088,836 | B1 | 8/2006 | Bachmann et al. | |
| 8,103,024 | B2 | 1/2012 | Bachmann et al. | |
| 2004/0057567 | A1 | 3/2004 | Lee | |
| 2006/0078102 | A1 | 4/2006 | Giannakouros | |
| 2006/0089170 | A1 | 4/2006 | Ashman, Jr. | |
| 2007/0006825 | A1 | 1/2007 | Chauhan et al. | |
| 2009/0012793 | A1 | 1/2009 | Dao et al. | |
| 2011/0140868 | A1* | 6/2011 | Hovang | G08B 25/008 340/12.55 |
| 2012/0109632 | A1 | 5/2012 | Sugiura et al. | |
| 2013/0082837 | A1* | 4/2013 | Cosentino | G06F 19/3418 340/539.12 |
| 2013/0339026 | A1* | 12/2013 | Lee | G06Q 10/109 704/274 |
| 2015/0070143 | A1 | 3/2015 | Means | |

OTHER PUBLICATIONS

Sparkfun—Office Door Castle Knocker by CTaylor/Jan. 27, 2012, http://www.sparkfun.com/tutorials/328.

PCT Search Report and The Written Opinion of the International Searhing Authority.

* cited by examiner

HAND CARRIED ALERTING SOUND GENERATOR DEVICE

CROSS REFERENCE TO RELATED APPLICATIONS

This application claims the benefit of U.S. provisional application Ser. No. 62/119,372 filed on Feb. 23, 2015; U.S. provisional application Ser. No. 62/143,272 filed on Apr. 6, 2015; and U.S. provisional application Ser. No. 62/198,202 filed on Jul. 29, 2015.

BACKGROUND OF THE INVENTION

This invention concerns devices for generating an alerting sound which make an occupant of a residence or other building aware of the presence of someone at the door who wishes to contact the occupant.

A door bell is often provided to more easily alert an occupant of the presence of someone at the door. When a button is pressed by the visitor, a sound is produced within the building such as the ringing of a bell or a buzzer.

The visitor may also simply knock on the door with a clenched fist in the age old manner to make his or her presence known to an occupant of the building. However, delivery personnel may make many calls in the course of the day and may over time experience discomfort or chronic injury from repetitively knocking on the door with his or her fist. Potentially injurious pounding of a hand on the hard surface of a door may discourage the delivery personnel from making a determined knocking effort, thus lowering the chances that a person will hear the knock and respond.

Another very common device to assist the visitor is the door knocker comprised of a pivoted knocker piece which strikes a fixed metal piece mounted on the door to enable a knocking sound to be made without requiring the visitor to knock on the door with his or her bare fist.

When a visitor attempts to announce his or her presence at the door by any one of these traditional practices it is usually not certain whether the occupant has heard the knocking or the door bell.

This is because the door bell often is not working or is not loud enough to alert an occupant in places within the building far from the door or the door bell sounder.

Similarly, a knocker may also not produce a loud enough sound to be heard in remote areas within the building, which also can happen with a visitor directly knocking on the door, especially if the visitor is reluctant to knock loudly due to a tenderness of his or her knuckles.

Furthermore, door bells, pivoted knockers, or other means are often not provided for a caller to use.

In some instances, when there is no response, a delivery driver will need to attempt a re-delivery, sometimes more than once, which wastes both time and resources of the delivery company.

Sophisticated electronic door bell systems have been developed which can provide voice messaging and other desired communications between an occupant and a visitor, but these have generally been too complex and expensive to make and install to come into general use. See for example devices described in U.S. Pat. Nos. 5,774,039; 6,721,408; 6,759,955; and U.S. patent publications 2006/0078102 and 2004/0057567.

The problems with conventional practices are especially acute for delivery personnel, door-to-door salespeople, census takers, mail carriers, etc. and for emergency personnel engaged in warning building occupants of the need to evacuate the premises.

Also, hotel and apartment staff may want to alert occupants of rented rooms or suites that they are about to enter the room for cleaning or other housekeeping purposes since ideally an entry should be announced by the staff personnel if the room is occupied to avoid unnecessarily startling the occupant.

It is an object of the present invention to provide a simple, low cost reliable device for generating a loud penetrating alerting sound able to be reliably heard within the interior of a building so that occupants will more certainly be made aware of a visitor being present at the door when compared with traditional methods described.

It is a further object of the invention to provide such a device which while being simple allows voice messages and/or other audio sounds to be broadcast into a building interior from a location adjacent the exterior of the building.

It is yet another object of the invention to provide such a device which is compact, lightweight and self-contained so as to allow portability by delivery and other personnel to be able to be hand carried and handled as necessary at any location at which they call without requiring any electrical connections or physical changes to be made to the building where the person is attempting to make contact with an occupant.

Another object of this invention is to provide a device for broadcasting verbal messages to occupants of a building that are in their language which may be of a different language than that of the user of the device or that of the language of pre-recorded messages stored in a source of audio signals included in the device of this invention.

It is another object of the invention to eliminate any need for people to forcefully knock at doors with their fists or to yell in order to gain the attention of an occupant of a building, thus eliminating potential hand injury or straining of the voice.

SUMMARY OF THE INVENTION

The above objects and other objects which will be understood by those skilled in the art are achieved by a portable, hand held alert sound generating device including an exciter feature of a transducer which exciter feature is caused to be vibrated in correspondence with electronic audio signals transmitted to the transducer. Commercially available "surface" transducers are suitable for this application, but other transducers able to drive an exciter feature with sufficient power may also be used.

The hand held device includes a case adapted to be gripped by one hand of a user and positioned against a door or other surface of the building exterior so that an exciter feature is thereby pressed against the exterior surface of a door or other building member.

Upon the device being switched on, either manually or automatically as when the device is pressed against a door surface by the user, alerting sounds are generated by the exciter feature being vibrated while being held in contact with the door or other member on the exterior of the building such as a window, which in turn causes resonance of the door or other exterior building member itself which thereby broadcasts corresponding loud alerting sounds into the building interior.

Specific broadcasted sounds can include a knocking sound, or that of chimes, a ringing bell, a buzzer, an identifying logo jingle or other sound which identifies a specific individual, a product or service, or a company such as a particular package delivery company, and/or playback of a recording of a spoken message and/or impromptu "live" spoken words or other sounds. Well known actor, personality, and spokespeople voices, cartoon character voices, unique or everyday sounds, etc. may advantageously be used.

As the above illustrates, virtually any combination and variety of sounds whether pre-recorded or "live" may be conveyed to the interior of a building using the device of this invention. The device easily accommodates different sounds, such as variations in door alerts used in various regions and countries, that, for example, may use alerting sounds other than "knock, knock".

The audio signals may be prerecorded and loaded into a rewritable solid state memory housed in the device case which are then amplified with a suitable audio amplifier prior to being transmitted to the transducer to create sufficiently loud sounds to be generated so as to be more reliably heard by occupants of the building than the alerting sounds created by conventional practices. These electronic components are powered by one or more batteries also held in the case.

Selective control over the operation of the device is provided, as by operation of one or more switches or other means so as to set the loudness of the sounds produced, or to enable selection of one of a plurality of different sounds for broadcasting into the building interior.

A microphone can also be included in the case or separately carried by the user which is connected to the amplifier with either hard wiring or by a Bluetooth™ or other wireless connection to enable broadcasting of a user's contemporaneously spoken message into the building interior.

Translation software can also be included to enable a foreign language version of a message to be broadcast by the user.

The case is preferably of a triangular shape to enable a secure grip of the device while operating the device with the same gripping hand, and also to provide convenient operation of one or more switches on the case by the thumb and/or fingers of the gripping hand of a user.

The device is sufficiently compact to be easily carried by the user in his or her pocket or on a keychain, and held with one hand when being used.

The device can also be coupled either physically in the same unit or electronically connected either directly by being hard wired or by indirectly by wireless means to a hand held package delivery data terminal to be able to broadcast into a building spoken unique information about a specific delivery to be made at the building, which is available from the terminal. Such data terminals are commonly carried by package and document delivery personnel as they contain necessary delivery information such as contents description, the recipient's name and address, the sender name, the time of delivery, etc.

DETAILED DESCRIPTION

Figure 1:
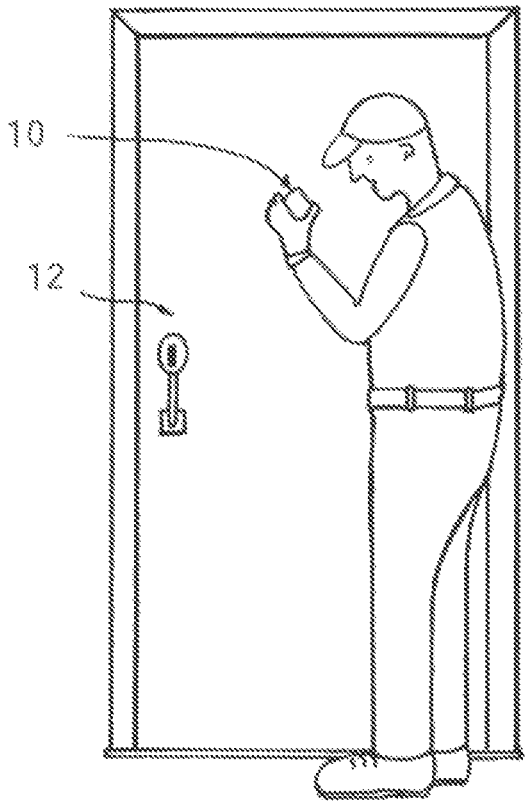
FIG. 1 is a pictorial view of a person standing outside of a building door holding in one hand an alerting sound generating device according to the invention.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings and particularly FIGS. 1-5, an alert sound generating device 10 according to the invention is shown gripped by one hand of a user and held pressed against the exterior surface of a building member such as a door 12. The device 10 also may be used on surfaces such as a wall or a building window.

Figure 4A:
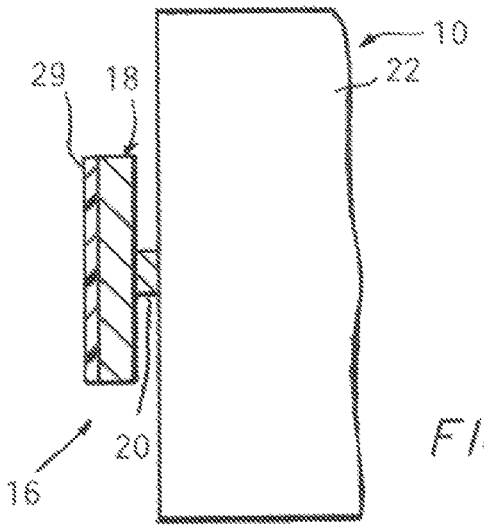
FIG. 4A is an enlarged fragmentary view in partial section of the transducer included in the device according to the invention.
Figure 4:
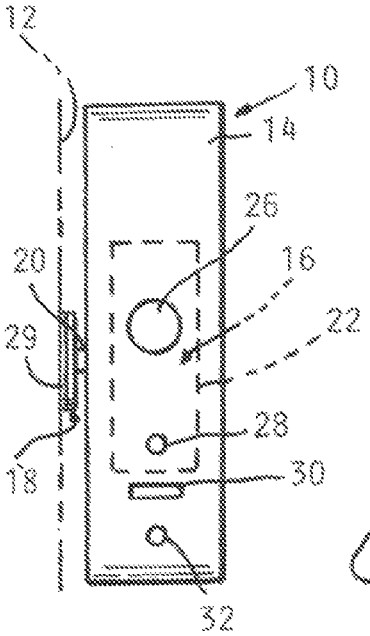
FIG. 4 is a side elevational view of the device shown in FIGS. 2 and 3.
Figure 3:
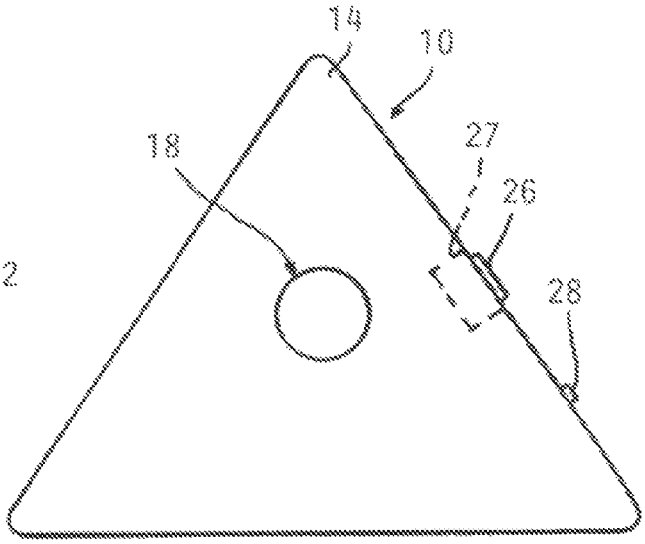
FIG. 3 is a rear elevational view of the device shown in FIG. 2 from the side which is positioned against the door surface.
Figure 5:
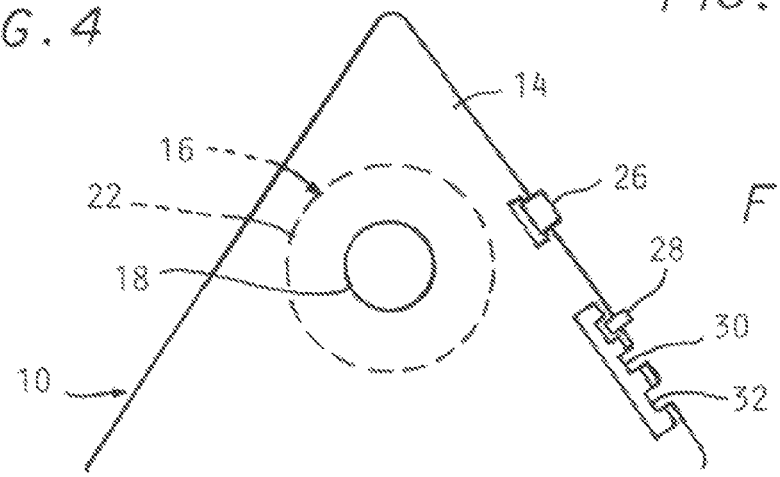
FIG. 5 is rear elevational view of the device as shown in FIG. 3 but with added features shown.

The device 10 preferably includes a triangular case 14 of a sufficient depth to house a transducer 16 (FIG. 4A) which has an exciter feature 18 which is vibrated during operation of the transducer 16 either directly or by a rod 20 connected to the exciter feature 18 and the transducer 16. The exciter feature 18 may be a metallic disc of a stiffness able to push on the door 12 (or other building member) with sufficient force to make the door 12 resonate when audio signals are transmitted to the transducer 16 and the exciter feature 18 is vibrated in accordance therewith.

Suitable so called surface transducers are commercially available and may advantageously be used for this purpose.

A suitable surface transducer which has been used in an alerting sound generator device 10 according to the invention is a Dayton Audio BCT-2 45×25 mm of a 10 watt power (RMS) and frequency response 300-20,000 Hz. This type of transducer enables the door itself to act as part of a speaker mechanism much like the vibrating cone of a traditional audio speaker. Such transducers may be used on materials including (but not limited to) metal, wood, glass, and combinations thereof, all of which commonly are used to construct doors and windows.

The exciter feature 18 may comprise a disc which protrudes out and is spaced slightly out from one side of the case 14 so as to be able to easily held in contact with the exterior surface of a door 12 or other building member when the one side of the case 14 is held so as to be urged towards the surface of the door 12.

Alternatively one side of the case 14 could itself be employed as an exciter feature (not shown) and would then have the one side pressed against the surface of the door 12 when the device 10 is in use. A thin cushion layer 29 which may be comprised of various materials such as hard rubber is bonded to the outer surface of the exciter feature 18 in the well known manner in order to insure good contact and act as an efficient conducting interface between the exciter feature 18 and the door 12 surface.

Figure 2:
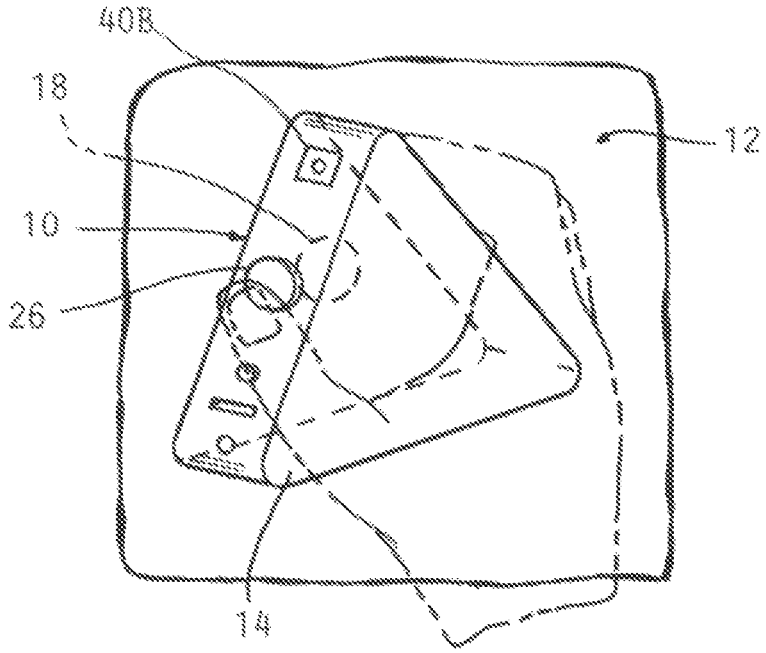
FIG. 2 is an enlarged pictorial view of the alerting sound generating device shown in FIG. 1 held against a flat surface of a door with the gripping hand of a user shown in broken lines.

A main on-off switch button 26 is provided on one side of the case 14, conveniently able to be pushed by the thumb as seen in broken lines in FIG. 2, but could be located on another side to be able to be conveniently be pushed by a finger of a user. The associated switch 27 (FIG. 3) may be of a two stage operation in which in a first stage it turns on the device 10 and causes a low volume sound output, and in a further second stage depression thereof it causes a higher volume output of sound to be broadcast by resonance of the door 12 into the building. Release of switch button 26 causes shut off of the device 10.

Figure 6:
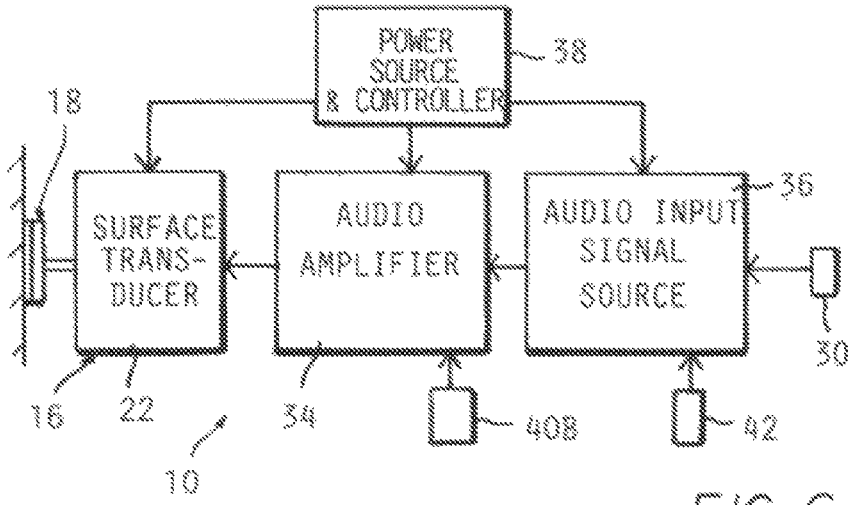
FIG. 6 is a block diagram of the functional components of one embodiment of a device according to the invention.
Figure 7:
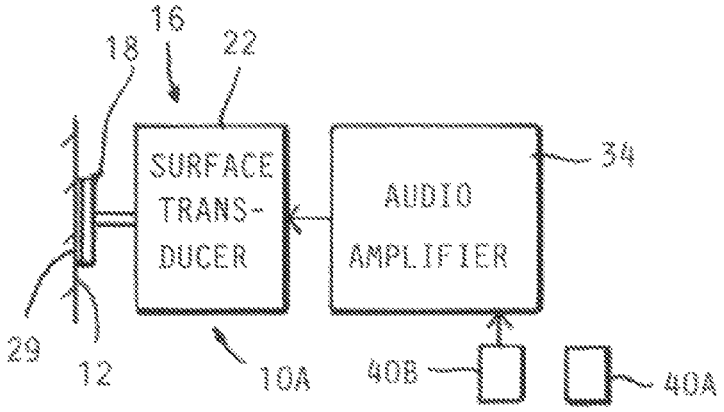
FIG. 7 is a block diagram of the functional components of a simplified embodiment of the device.
Figure 11:
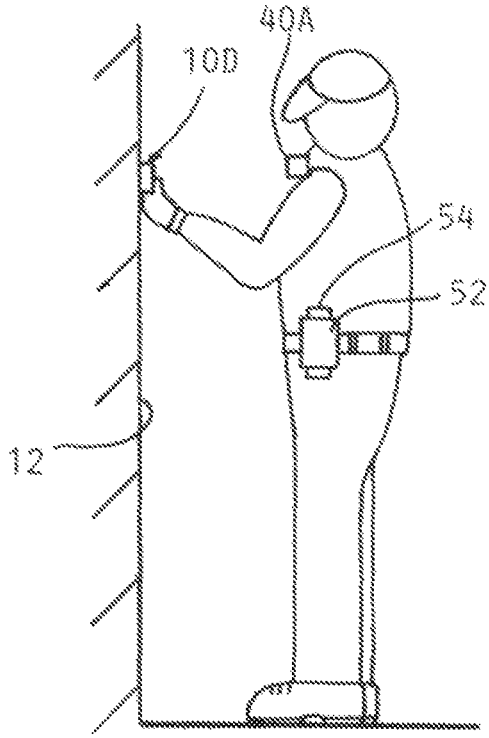
FIG. 11 is a pictorial view of a person at a door who is equipped with a modified version of a device according to the invention.

A smaller selector switch button 28 may also be provided to enable audio track selection to select a desired prerecorded sound and/or to select either a male/female voice for spoken alerts or messages. This selector switch button 28 may also select when "live" impromptu messages from the user as spoken into a microphone 40A or 40B are wished to be merged or alternatively to be broadcast into the building via transducer 16. The microphone 40A may be worn on the user as seen in FIG. 11, while microphone 40B may be attached to case 14 as seen in FIGS. 2, 6 and 7.

An audio port 30 (FIGS. 4, 5, 6, 7, 8, 12) is also provided for uploading prerecorded audio files as from a computer hard drive (not shown) to audio input signal source 36 (FIG. 6, 8) which may be the Adafruit Mini FX Sound Board #2342 used for both accepting and storing uploaded sound files in re-writable semiconductor memory as well as transmitting the audio sound files to an audio amplifier 34. Each user can thus easily customize the device of this invention by using recorded sound files that meets their specific and possibly changing requirements.

Audio files may be created using a wide variety of readily available free audio creation software programs. An infinite variety of audio sounds and/or spoken messages may be used such as "knock, knock, knock" or "knock, knock, It's the nurse, I'm coming in", or 'Apartment maintenance at the door", or "It's Mary at the door", or "Emergency evacuation, gas leak, leave the building! Now", or proprietary well known audio sounds such as "Ding, dong, Avon calling!", or "knock, knock, this is ABC Delivery Company with a package". The audible messages may run in a continuous loop if selected to do so by operation of switch 28.

The audio sound produced by the device of this invention may be an amplified conventional door bell, buzzer, or chime sounds instead of a knocking sound to avoid the possibly startling effect of a knocking sound heard within the building which is louder than the noise made by a person knocking on the door.

A battery charging port 32 (FIG. 4, 5) is also provided for charging batteries (not shown) contained in the case 14.

The case 14 also holds other electronic components required, including the audio amplifier 34, an audio input signal source 36, and a power source and controller 38 (FIG. 6). The power source 38 may include one or more preferably rechargeable batteries.

For broadcasting amplified speech of the user into the building interior by the device 10, a microphone 40A or 40B may be wirelessly or hard-wired connected to the audio amplifier 34 (FIGS. 6-7).

Referring to FIG. 1, a user holds device 10 in one hand and moves device 10 towards the outside door surface 12 until the contact layer 29 of the exciter feature 18 (FIG. 4A) rests substantially flat against the door 12 surface. A previously selected audio track stored in audio input signal source 36 may be changed or selected by operation of selector switch button 28 with an available thumb or finger of the hand that is holding device 10. On-off switch button 26 is depressed causing switch 27 to activate (power up) the circuitry of the device 10, whereby signals corresponding to stored prerecorded audio sounds are passed to audio amplifier 34 whereby such signals are amplified and fed into transducer 16 whereby transducer portion 22 vibrates causing connecting rod 20 to vibrate exciter feature 18 which is in solid contact with door 12 via interface layer 29 (FIG. 4A) which causes door 12 to vibrate and act as a speaker and broadcast sound by resonance of the door 12 into the interior of the building. By further depressing on/off switch button 26, the sound level generated by the transducer 16 is increased.

Selective movement of selector switch button 28 during this broadcast of sound enables "live" impromptu spoken sound to be generated by the user speaking into a microphone 40B (shown in FIG. 6) to also be generated instead of or in addition to the prerecorded sounds generated by audio input signal source 36. Releasing all pressure from on-off switch button 26 causes the device 10 to turn off and power down.

A separate flash memory 42 (FIG. 6) or equivalent may be connected to upload a variety of messages or sounds into the signal source 36.

A simpler embodiment of the device 10A is shown in FIG. 7 where only a microphone 40A is shown wirelessly connected to the audio amplifier 34 or a microphone 40B as shown hard-wired thereto, such that impromptu live verbal messages may be broadcast into the building interior by the resonance of the door 12.

This is quite useful for example if a building occupant yells through a closed door a question to a delivery person, as then the delivery person can answer by calmly speaking in a normal voice into microphone 40A or 40B and an audio amplifier 34 amplifies the voice audio signals and the transducer 16 converts the same to corresponding vibrations of the exciter feature 18 so that the person's voice is made much louder such that an occupant will clearly hear the answer. The delivery person thus maintains a professional manner and the there is no need to strain his or her voice by yelling through a closed door and disturbing nearby unrelated occupants.

The device 10A is particularly useful for emergency workers that need to provide loud penetrating customized announcements the content of which is unanticipated, i.e., the audio message is not able to be pre-recorded, to occupants located behind closed doors within a building during an emergency situation such as an evacuation.

Figure 8:
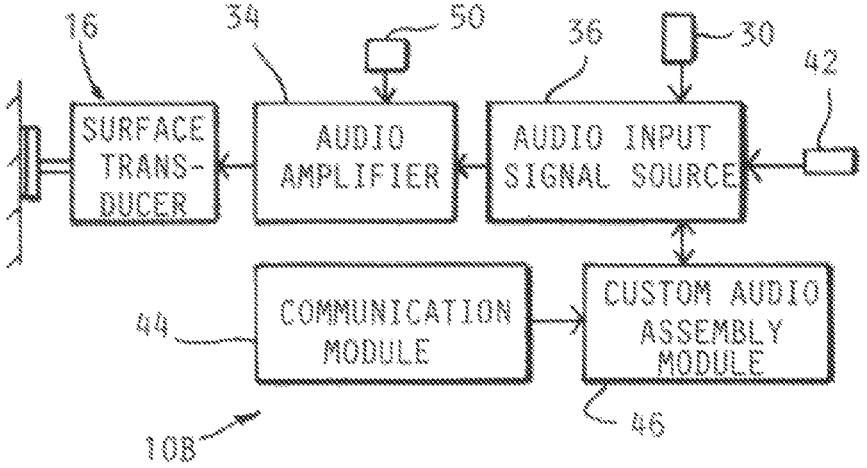
FIG. 8 is a block diagram of the functional components of another embodiment of a device according to the invention incorporating additional features.
Figure 9:
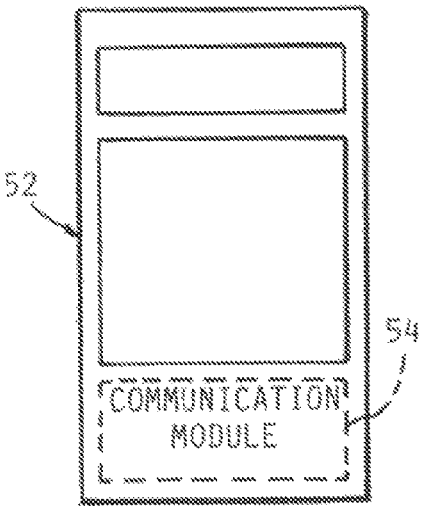
FIG. 9 is a front view of a package or document delivery data terminal with an integrated wireless communications module.

FIG. 9 depicts a hand-held package delivery terminal 52 which is normally carried by delivery personnel where such device holds an electronic record of data regarding particular shipped items, i.e., the name of a shipper, the customer name, the order number, etc. Delivery terminal 52 is shown in combination with a communication module 54 which wirelessly transmits such data record to the communication module 44 in FIG. 8.

Referring to FIG. 8, in another embodiment of the device 10B, that electronic record is converted into an electronic audio file of the data in spoken form by a custom audio assembly module 46, and merged with stock audio file(s) accessed from audio input signal source 36 whereby a customized audio file message is loaded into the audio input signal source 36 to be broadcast into the building using door 12 (or a window) as a speaker as described above.

The above described customized audio integration processes are well known to those skilled in the art. Such technology is commonplace in interactive audio voice applications such as telephone banking as well as used in the everyday production of audio tracks for internet YouTube-.Com videos.

For example, a mixed collection of stock audio message audio files which may consist of knocking sounds and spoken words such as "Knock, knock, this is ABC Delivery Company with a package for" has previously been uploaded via audio input port 30 and stored in audio input signal source 36 (FIG. 8). Communication module 44 of device 10B receives specific delivery data from communications module 54 of the Package Delivery Terminal 52 indicating that a package is to be delivered to "Mr. Ted Smith".

Custom audio assembly module 46 (FIG. 8) uses this data to create a corresponding verbally spoken audio file of the spoken data "Mr. Ted Smith" and merges this file with the audio file "Knock, knock, this is ABC Delivery Company with a package for" received from audio input signal source 36 to create a customized audio file containing "Knock, knock this is ABC Delivery Company with a package for Mr. Ted Smith". This customized file is transferred to audio input signal source 36 whereby corresponding audio signals are then provided to audio amplifier 34 with the output transmitted to transducer 16 for a broadcasting corresponding sound into the building interior by the resonance of the door 12.

Such a customized message would provide a higher percentage of successful contacts, i.e., door openings with an occupant as the recipient may be waiting for an important package addressed to "Mr. Ted Smith" and would be motivated to open the door. They may not open the door if they don't know who is on the other side of the door and may simply ignore a generic "knock, knock" sound, thinking that perhaps a neighbor, door-to-door salesperson, or unknown stranger is on the other side of the door. Such a customized audible message results in greater productivity for delivery companies as they do not have to repeatedly return back to the same address to attempt a re-delivery.

Greater productivity results in lower costs and greater customer satisfaction. The above detailed customized audible message provided to the occupant also saves the delivery person time and his or her voice as they traditionally would need to take time to look up package details and then yell the result through the door to the occupant.

A volume control switch 50 (FIG. 8) associated with the audio amplifier 34 may be included in each embodiment to enable selective varying of the loudness of the broadcasted sounds.

As noted above, FIG. 9 shows a hand-held package delivery data terminal 52 combined with a wireless communication module 54 for transmitting data to a separate alerting sound generating device 10 according to the invention to enable data in the terminal to thereby be able to be announced to an occupant in the building such as in a response to a query from the occupant.

Figure 10:
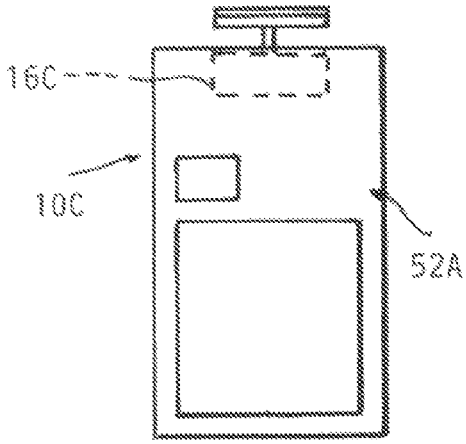
FIG. 10 is a front view of a device according to the invention combined with a hand held package delivery data terminal shown in FIG. 9.

FIG. 10 shows a package delivery terminal 52A combined with an alerting sound generator device 10C according to the invention. This combination embodiment has the advantage that only one item needs to be carried to operate the functions of both devices. In this embodiment, transducer 16C may be integrated into the top end of the package delivery terminal 52A and simply held firmly and flush against the outside of a door 12 in order to broadcast audio into the building.

FIG. 11 shows a delivery person holding an alerting sound generator device 10D according to the invention against a door surface 12. A separate package delivery terminal 52 which is wirelessly coupled via the included communications module 54 to communications module 44 included in the device 10D as with a Bluetooth™ or other wireless connection such as FM or physical wired connection thereto, worn on the belt of the person.

Microphone 40A may also be worn on the front of the upper chest of the user, or could be worn on a hat or with ear phones or located elsewhere able to detect the voice of the delivery person.

Figure 12:
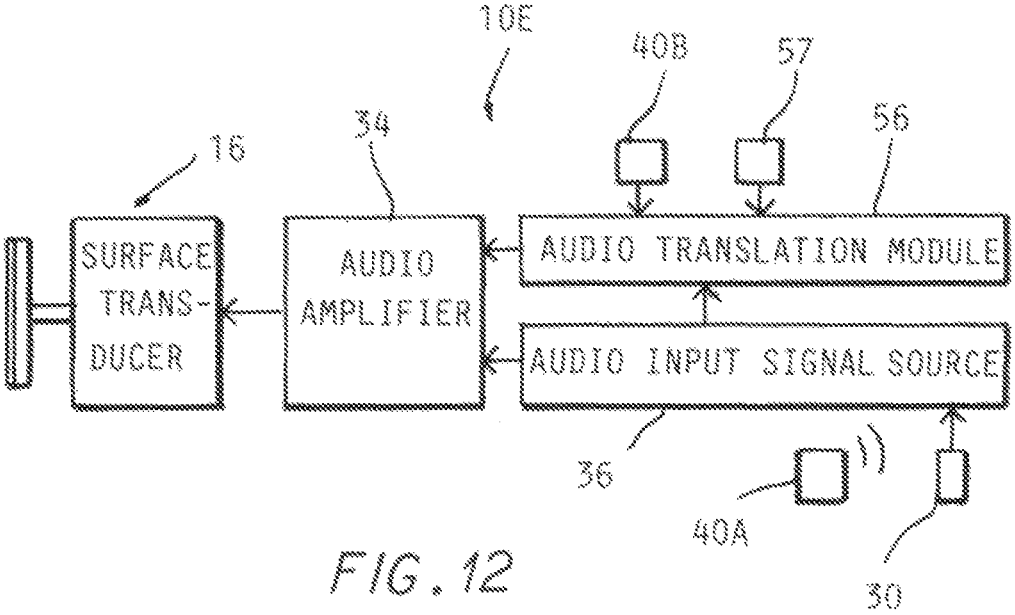
FIG. 12 is a block diagram of additional components added to the device according to the invention.

FIG. 12 shows an alternate embodiment of the device 10E of this invention whereby the sounds for the audible door alerting sound generator may originate from the user such as by a wirelessly connected microphone 40A worn by the user. The microphone audio signals are received by a wireless communication receiver module 44 shown in (FIG. 8). Such audio signals may also originate from a sound input device such as a microphone 40B (FIGS. 2, 7) which may be physically a part of the device of this invention.

Such signals are transmitted to an audio translation module 56 which converts in real time the original spoken language of a user to a different selected language specified by the user as by operation of a switch 57, which is detected by the audio translation module 56, or other means. Technology for real-time language translation is in current use as for example on the Google searching website which provides such electronic language translation abilities.

The resultant language converted audio signal produced by the audio translation module 56 is then amplified by audio amplifier 34 and then used to excite the door 12 by the transducer 16 to broadcast a message to the occupants of a building. Stock pre-recorded audio messages stored in audio signal input source 36 may also be processed and converted in different languages through the audio translation module 56 and reproduced by operation of the transducer 16.

The ability of the device of this invention to convert a source input language to various other languages enhances the versatility and use of this device for many applications such as when a package delivery driver is assigned to work in an area in which the driver's native language is not used, the driver is able to effectively communicate with customers without needing to have a different driver return to the location which wastes time and resources, and delays the delivery of a package or documents to the customer.

Another example is when an emergency worker needs to provide "live" impromptu instructions to the occupants of a building through closed doors. The ability of the device to provide emergency instructions in a variety of languages extends the abilities of the emergency worker to effectively communicate through closed doors with occupants who may not understand the language spoken by the emergency worker or the language used in stored pre-recorded messages in audio input signal source 36 both of which may be translated by audio translation module 56. Such occupants may otherwise ignore emergency instructions if heard in a language that they do not understand.

Figure 13:
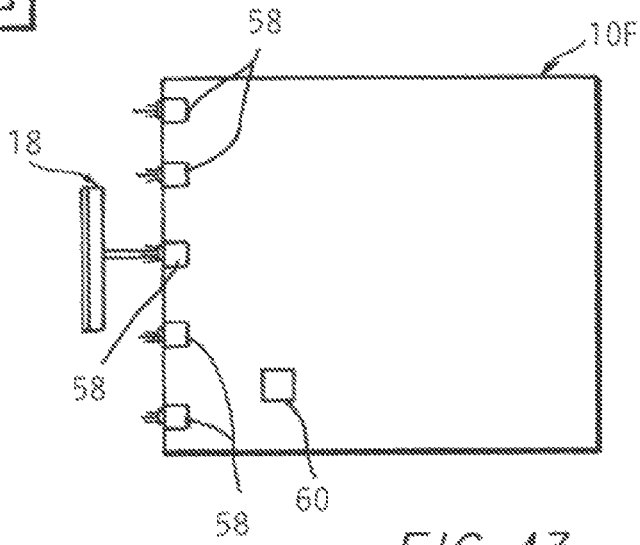
FIG. 13 is an enlarged side view of a cylindrically shaped device according to the invention equipped with an array of LED lights for illuminating a door or other surface.

FIG. 13 is a side view of a cylindrically shaped device 10F according to the invention having a series of lights 58 which are directed towards the area of the door or other building surface where the exciter feature 18 may be placed against that surface. At night or in darkened areas these lights 58 will provide illumination of a surface where the device 10F of this invention is to be employed. A substantially flat surface area may then be easily located to optimize contact of the exciter feature 18 with the surface.

Figure 14:
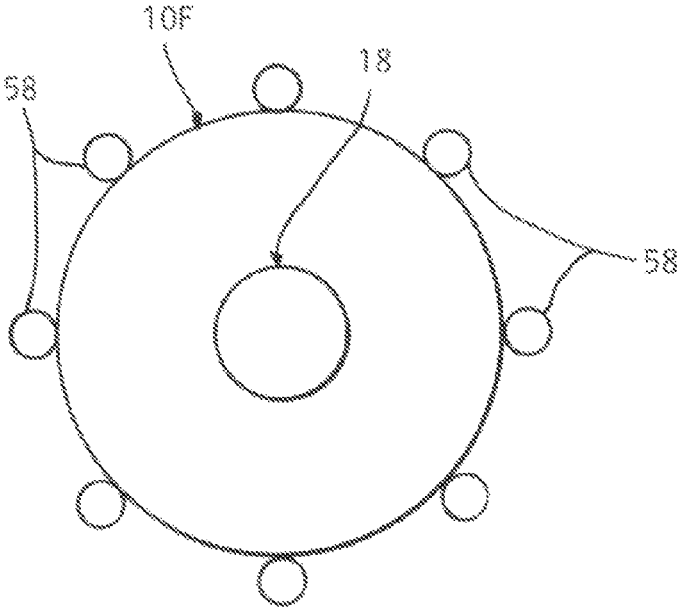
FIG. 14 is a front view of the device shown in FIG. 13 equipped with an array of LED lights for illuminating a door or other surface.

FIG. 14 is a front view of the device 10F looking at the transducer exciter feature 18 where lights 58 illuminate in the same direction that the device of this invention is pointing. Light sources such as LED's (Light Emitting Diodes) may be used for each light source 58, although other light sources and lighting arrangements may be employed. The illumination level as well as an on/off state may be controlled by a user controlled switch 60 (FIG. 13) or automatically by a light sensor (not shown) which may detect low levels of light whereby the lights 58 automatically turn on.

The device 10 according to the invention thus makes it effortless and harmless to the user's hands or voice to produce loud, sustained, and unmistakable alerting sounds audible to persons located deep within the interior of a house or building.

The invention claimed is:

1. A hand held alerting sound generator device for broadcasting sounds into the interior of a building to signal to an occupant that a visitor is at a door of the building who is seeking to make contact with an occupant, comprising:

a casing of a size able to be gripped by one hand of a user;

a transducer held by said casing, said transducer having an exciter feature able to be held in contact against an exterior surface of a member of said building by a user while gripping the casing;

said exciter feature being vibrated in correspondence to audio signals from an audio signal source by operation of said transducer, whereby said exciter feature when held against said external surface of said building member, causes said building member to correspondingly resonate and thereby broadcast sounds corresponding to said audio signals into said interior of said building.

2. The device according to claim 1 wherein said audio signals correspond to either a knocking sound, a ringing bell sound, a buzzer sound, or chime sounds to imitate conventional devices used to make an occupant of a building aware of a visitor at a door to the building.

3. The device according to claim 1 wherein said audio signals correspond to a spoken message.

4. The device according to claim 3 wherein at least some of said audio signals are generated by a microphone whereby words that are spoken into said microphone are broadcast into said building interior by said device.

5. The device according to claim 1 wherein said source of audio signals stores audio signals corresponding to a plurality of types of sounds any of which may be selected by a user by operation of a selector control to enable a selected one or more of said plurality of types of sounds to be broadcast into said building interior.

6. The device according to claim 5 further including a source of contemporaneously generated voice audio signals and wherein said selector control enables any of said plurality of sounds or said contemporaneously generated voice audio signals to be selected by a user by operation of said selector control so as to enable any of said plurality of types of sounds or said contemporaneously generated voice sounds to be broadcast into said building interior by said device.

7. The device according to claim 4 further including a translator creating audio signals corresponding to said spoken words in a different language from said contemporaneously spoken message or a prerecorded spoken message.

8. The device according to claim 1 further including an electronic connection to a terminal storing in electronic form shipping data and an audio converter producing audio signals of said data stored therein and transmitting said audio signals to said transducer whereby voice broadcast of said data into said building interior may be done by said device.

9. The device according to claim 1 wherein said case is triangular in shape having three sides and a triangular top and bottom.

10. The device according to claim 9 where one or more switch operator buttons are located on at least one of said casing sides.

11. The device according to claim 1 further including one or more lights mounted to said casing enabling illumination of said exterior surface of said building member.

12. The device according to claim 1 wherein said transducer is a surface transducer.

13. A method of generating sounds to alert an occupant in the interior of a building that a visitor is at a door to the building, seeking to contact an occupant, comprising the steps of manually holding a case against an outside surface of a member of said building by a user while activating a transducer having an exciter feature thereby engaged with said surface to vibrate said exciter feature which in turn vibrates said surface in correspondence with audio signals from a source of audio signals by operation of said transducer to thereby cause said building member to resonate and thereby generate sounds broadcast into the interior of the building.

14. The method according to claim 13 wherein a plurality of types of audio signals each corresponding to different sounds are prerecorded and stored by said device and used to operate said transducer and selecting any of said audio signals or combinations thereof to be applied to said building member outside surface by said exciter feature whereby any of said sounds can be selectively broadcast into said building interior.

15. The method according to claim 14 wherein said sounds include one of a ringing bell sound, the sound of chimes, a knocking sound, and a spoken message.

16. The method according to claim 14 wherein at least one of said audio signals are produced contemporaneously by a microphone spoken into by a user.

17. The method according to claim 16 wherein at least some of said audio signals correspond to a prerecorded voice message and are stored in said audio signal source, and either or both of said contemporaneous or prerecorded voice messages are selectively caused to be broadcast into said building interior.

18. The method according to claim 13 wherein said audio signals correspond to the sound of advertising jingles or famous voices.

19. The method according to claim 16 wherein said voice messages are selectively in a male or female voice.

* * * * *